United States Patent [19]

Straub

[11] Patent Number: 4,821,329

[45] Date of Patent: Apr. 11, 1989

[54] AUDIO SWITCH DEVICE WITH TIMED INSERTION OF SUBSTITUTE SIGNAL

[76] Inventor: Gary Straub, 1002 Folsom Ave., Mays Landing, N.J. 08330

[21] Appl. No.: 70,423

[22] Filed: Jul. 7, 1987

[51] Int. Cl.[4] ..... H04R 27/00

[52] U.S. Cl. ..... 381/119; 381/105; 381/107; 381/110; 381/122; 379/389

[58] Field of Search ..... 381/107, 110, 105, 119, 381/122; 375/60; 455/116; 379/389

[56] References Cited

U.S. PATENT DOCUMENTS

| | | | |
|---|---|---|---|
| 2,766,378 | 10/1956 | Sundin et al. | 381/110 |
| 3,518,375 | 6/1970 | Hawkins | 381/110 |
| 3,952,154 | 4/1976 | Gates, Jr. . | |
| 4,306,114 | 12/1981 | Callahan . | |
| 4,347,510 | 8/1982 | Ishigaki et al. | 340/825.5 |
| 4,357,488 | 11/1982 | Knighton et al. | 381/110 |
| 4,491,980 | 1/1985 | Ichikawa | 381/107 |
| 4,589,137 | 5/1986 | Miller | 381/94 |
| 4,596,021 | 6/1986 | Carter et al. | 375/5 |
| 4,596,033 | 6/1986 | Swinbanks | 381/71 |
| 4,625,083 | 11/1986 | Poikela | 379/389 |

*Primary Examiner*—John W. Caldwell, Sr.
*Assistant Examiner*—Tyrone Queen
*Attorney, Agent, or Firm*—Steele, Gould & Fried

[57] ABSTRACT

A switching device operable to monitor for the presence of an audio signal on a primary input line to a mixer includes a retriggerable timer responsive to activity on the primary line. When activity ceases for a predetermined time interval, the retriggerable timer connects to the mixer a substitute program, for example background music to be played through a different mixer input channel during performers' break. The switching device is operable for professional-type balanced low impedence audio systems wherein the mixer impresses a DC bias on the signal line to power condensor microphones. The microphones remain operational whether or not the substitute program is enabled. Upon resumption of microphone activity on the primary line, the switching device is automatically reset.

18 Claims, 3 Drawing Sheets

AUDIO SWITCH DEVICE WITH TIMED INSERTION OF SUBSTITUTE SIGNAL

BACKGROUND OF THE INVENTION

1. Field of the Invention

This invention relates to the field of automatic signal switching for audio systems and in particular to a switching system responsive to a performer's vocal or instrument microphone, including a dead air timer arrangement automatically inserting a secondary program in the event of inactivity on the primary audio circuit.

2. Prior Art

Voice operated switched are known for controlling tape recorders and the like. In typical voice operated switching systems, the initiation of a signal on a voice line is detected and causes immediate commencement of recording. Upon cessation of activity on the line, the voice operated switch allows the recorder or the like to record for a further timed period selected to be longer than a delay typical of ongoing speech. If speech resumes during the delay, recording continues. Accordingly, the recorded information is automatically edited to reduce the length of gaps. An example of a voice operated switch can be found in U.S. Pat. No. 4,625,083—Poikela. While voice operated switch devices are useful for recording, they do not address the problem of audio switching in connection with live performance situations, where gaps in a program cannot be edited away.

A typical live performer such as a piano player in a lounge or the like, will play for a given length of time, for example an hour, and take a short break, for example fifteen minutes. During the break, it is useful for the benefit of patrons to provide a back-up audio program, which may or may not be of a similar type to the live program of the performer. Typically, the performer or a technician is expected to switch on a secondary signal source at the beginning of a break and switch off the secondary source when the program resumes. In many situations such as professionally-operated audio systems operated by audio technicians, the performer must strictly adhere to a regular schedule. According to plan, the audio technician punctually arrives to initiate the background program, and returns later to turn off the background program as the performer returns. Should the performer fail to adhere to a regular schedule or be required for whatever reason to take an unscheduled or irregular break, the background music may be unavailable or the audio technician's time may be wasted.

The present invention relates to a switch device included a dead air timer retriggerable at each instance of detected signal activity on the primary audio line. The primary audio line in this context may be a life performer's vocal microphone, an instrument microphone signal, or may be some other form of primary audio signal to be employed whenever available, and superceding other signal sources. For this purpose, an automatic switch is used not merely to start or stop tape recorders or players and the like, but to gate the respective signals through to a mixer and to determine based upon activity in the primary signal which of the signals is to be mixed and played. Preferably, the invention is used together with a mixer having a plurality of input channels, with the switched secondary source being routed to a different channel than the primary source and the connection between the secondary source and its channel being made through a controlled connection.

In connection with video switching devices, it is known to provide a storage means for storing the last scan line or last entire frame, and to re-insert the last line or last frame in the event a malfunction is detected in the transmission of a current line or frame. While it may also be possible to automatically switch among various video sources in the event of a malfunction in one, such a switching system is not responsive to activity on a primary line, such activity being present in any event.

In connection with audio switching systems generally, it is known to employ various switching techniques and various sensors and amplifiers in order to develop switching criteria for enabling certain systems. For example, U.S. Pat. Nos. 4,596,033—Swinbanks and 4,589,137—Miller involve switched enabling of audio signals responsive to detection of noise activity on a channel, the switched-in signal being an out-of-phase version of the background noise intended to be summed together with the basic signal to cancel or reduce noise levels. U.S. Pat. No. 4,596,021—Carter, et al, also involves a switching system allowing a telephone modem to switch back and forth between voice and data communications. Disclosures such as these, and voice operated switches such as Poikela lack means for automatic switching in both directions between alternative sources as needed to automatically produce a background music program or the like during gaps in live performances.

Instrumental performers frequently dispose a bank of switchable effects modules in series between their instruments and their amplifiers. These are adapted for manual control and switchably alter the primary signal or simply pass the primary signal. Such modules do not typically interact between channels and do not time dead air on one line for switching another line onto the output.

According to the invention, a switching system for detecting gaps in live performances and for switching in a secondary signal source upon detection of a long gap, is provided as a switching device to be inserted in series with both the primary and secondary input lines, leading to a multi-channel mixer. The switching system passes the primary to one mixer channel and upon dead air time-out, connects the secondary signal to another channel. In order to allow power to pass backwards, from the mixer to the audio signal source, for powering condenser microphones and the like (i.e. phantom power), the device is AC coupled to one or both signal lines through a high pass filter. An amplifier having a preferably adjustable gain in order to set the minimum level to be interpreted as "activity" is operated together with a second amplifier. The second amplifier preferably operates in saturation, providing a digital pulse train during periods of activity and either a high or low level during inactivity. A phase selection switch allows the user to invert the digital pulse train from the second amplifier if necessary, to produce low-going pulses on the output, indicating activity. A retriggerable timer having a preferably-adjustable time period determined by charging of a capacitor through a resistor is connected to a transistor conducting during the negative-going pulses, the transistor being thereby operable repeatedly to discharge the timing capacitor and thereby retrigger the timer during periods of activity. Upon time-out, the timer output drives a relay which connects the secondary or "controlled" signal to a second input channel of the mixer or the like.

SUMMARY OF THE INVENTION

It is an object of the invention to provide an automatic control operable to detect loss of a primary input signal such as a live performance microphone and to automatically switch in a background program.

It is also an object of the invention to adapt typical professional hardware attributes of a professional sound system, using a convenient and inexpensive modular switching device for inserting a background or alternate program upon loss of a primary program.

It is another object of the invention to produce switch closures for general purpose use, for indicating whether an audio system is currently processing a primary or secondary source signal and/or for controlling auxiliary devices.

It is still another object of the invention to relieve performers and audio technicians from the need to coordinate commencement of breaks and performance periods in live performance situations.

These and other objects are accomplished by a switching device operable to monitor for the presence of an audio signal on a primary input line. The switching device includes a retriggerable timer responsive to activity on the primary line. When activity ceases for a predetermined time interval, the retriggerable timer switches in a substitute program, for example background music to be played on a different mixer input channel during a performer's break. The switching device is operable for professional-type balanced low impedance audio systems including those supplying power for condenser microphones from the mixer, i.e., in a direction opposite the flow of the audio signal. Upon resumption of activity on the primary line, the switching device is automatically reset.

BRIEF DESCRIPTION OF THE DRAWINGS

There are shown in the drawings the embodiments that are presently preferred. It should be understood that the invention is not limited to the precise arrangements and instrumentalities shown in the drawings, wherein.

DETAILED DESCRIPTION OF THE PREFERRED EMBODIMENTS

Figure 1:
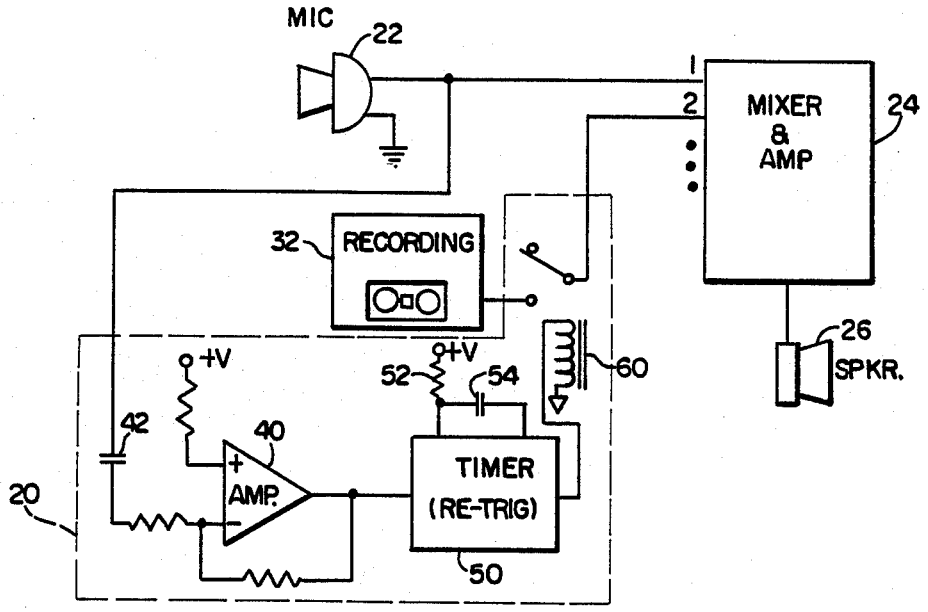
FIG. 1 is a schematic illustration of an audio system incorporating a basic version of the subject invention.

FIG. 1 illustrations a simple version of a live performance application of the audio switch of the invention. A microphone 22 providing one input signal to mixer 24, is connected to a first channel of the mixer. A secondary audio program is at the same time available on standby, for example from a radio program, a recorded source such as tape player 32, or the like. It is also possible to switch the audio program for one live program location into the mixer system for another location during breaks, connecting switching devices according to the invention in cascade. Typically, the secondary source is immediately associated with the area of the live performance, being a tape player 32 or the like, located in the area of the mixer and amplifier 24. Mixer and amplifier 24 will sum the signals present on the various input channels, each of which normally has separate volume and tone controls. The output of the mixture or summation of the input signals is amplified and applied to a speaker 26 in the area of the live performance. As shown in FIG. 1, during the normal situation in which microphone 22 is in use, the output of recording apparatus 32 is not connected to the mixer and amplifier 24. Therefore, only the microphone signal is presented on speaker 26. The tape player or other secondary source 32 remains operative but is not connected to the mixer.

Mixer 24 can provide power for operation of condenser microphones by impressing a DC bias voltage of about 50 volts on the signal line from microphone 22. This is sometimes called "phantom power" and requires a direct (unswitched) connection between microphone 22 and mixer 24 to remain operative. Accordingly, if microphone 22 is a condenser microphone requiring external power, this is available directly from the signal lines plugged into the mixer. Detection and timing apparatus 20 is connected to the output of microphone 22 through a DC blocking capacitor 42. So long as there is AC activity on the line from microphone 22 to mixer 24 (i.e., so long as an audio signal is present), amplifier 40 will produce an output. The output of amplifier 40 is a proportional version of the input signal, and may be described as the summation of sine waves at various frequencies. The output of amplifier 40 will cross nominal digital logic threshold voltages (e.g., 0.7 V and 3.0 V) and thereby will cause retriggerable timer 50 to continue timing. If timer 50 is not retriggered for a predetermined time, then timer 50 "times out" and produces an output to operate relay 60. Relay 60 connects the output of recording device 32 to a second channel of mixer 24, which situation remains until resumption of signal activity on the primary line. The time out period of timer 50 is determined by the time delay in charging capacitor 54 up to a certain threshold voltage through resistor 52, attached to the positive voltage supply.

In accordance with the invention as illustrated in a simple form in FIG. 1, so long as microphone 22 is active, the audio output of recording device 32 will remain disconnected from the mixer and amplifier 24. Therefore, the signal at speaker 26 will be only that from microphone 22. Retriggerable timer 50 begins to time after every transition on its input. When timer 50 times out due to lack of a transition for a present time, both microphone 22 and recording device 32 will be connected at the same time to mixer 24. Practically speaking, only the output of recording device 32 will appear on speaker 26 because no audio activity is present on microphone 22 when the secondary source is switched. By virtue of the connections shown, any input occurring on microphone 22 of a threshold sufficient to reset retriggerable timer 50, will immediately disconnect the secondary audio source by removing the output of retriggerable timer 50 that otherwise keeps relay 60 in an energized condition.

Figure 2:
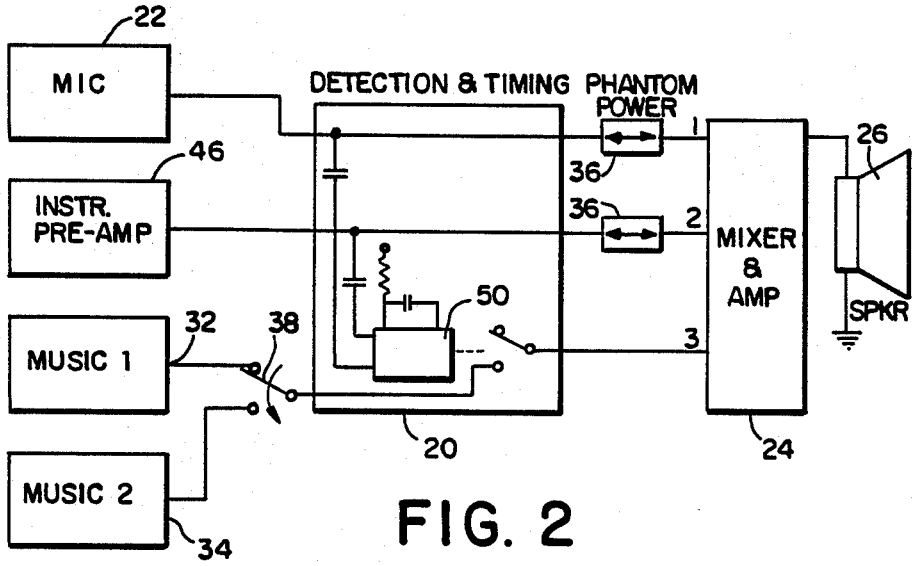
FIG. 2 is a block diagram showing connection of the switching apparatus of the invention to a typical live performance audio system.

FIG. 2 is a block diagram showing various audio signals sources and means in an overall system adapted for live performance situations. Mixer and amplifier 24 and speaker 26 produce the ultimate audio output of the system. The various input channels to mixer and amplifier 24 include, for example, the outputs of microphone 22, instrument preamplifier 46 and one or two alternative background music sources 32, 34, switch selectable by means of switch 38 and automatically selected by detection and timing apparatus 20. Phantom power supplies 36 which can be add-on modular AC power devices connected in series with the audio inputs, provide power to the microphone and/or instrument preamplifier by impressing a DC bias on the signal lines. It is also possible that the instrument preamplifier 46 could be replaced by a microphone, instrument pick-ups being a form of microphone in any event. Retriggerable timer 50 is connected to one or both of the audio lines for microphone 22 and instrument preamplifier 46 through DC blocking capacitors intended to block the DC voltage supplied from phantom power supplies 36. According to this embodiment, should activity occur on either microphone 22 or instrument preamplifier 46, retriggerable timer 50 will keep timing, keeping disconnected music source 52 or 34, as selected through switch 38. Should retriggerable timer 50 time out, one or the other of music sources 32, 34 will be connected to the third input channel of mixer and amplifier 24, and will provide the audio output of the system until activity resumes on either microphone 22 or instrument preamplifier 46.

Figure 3:
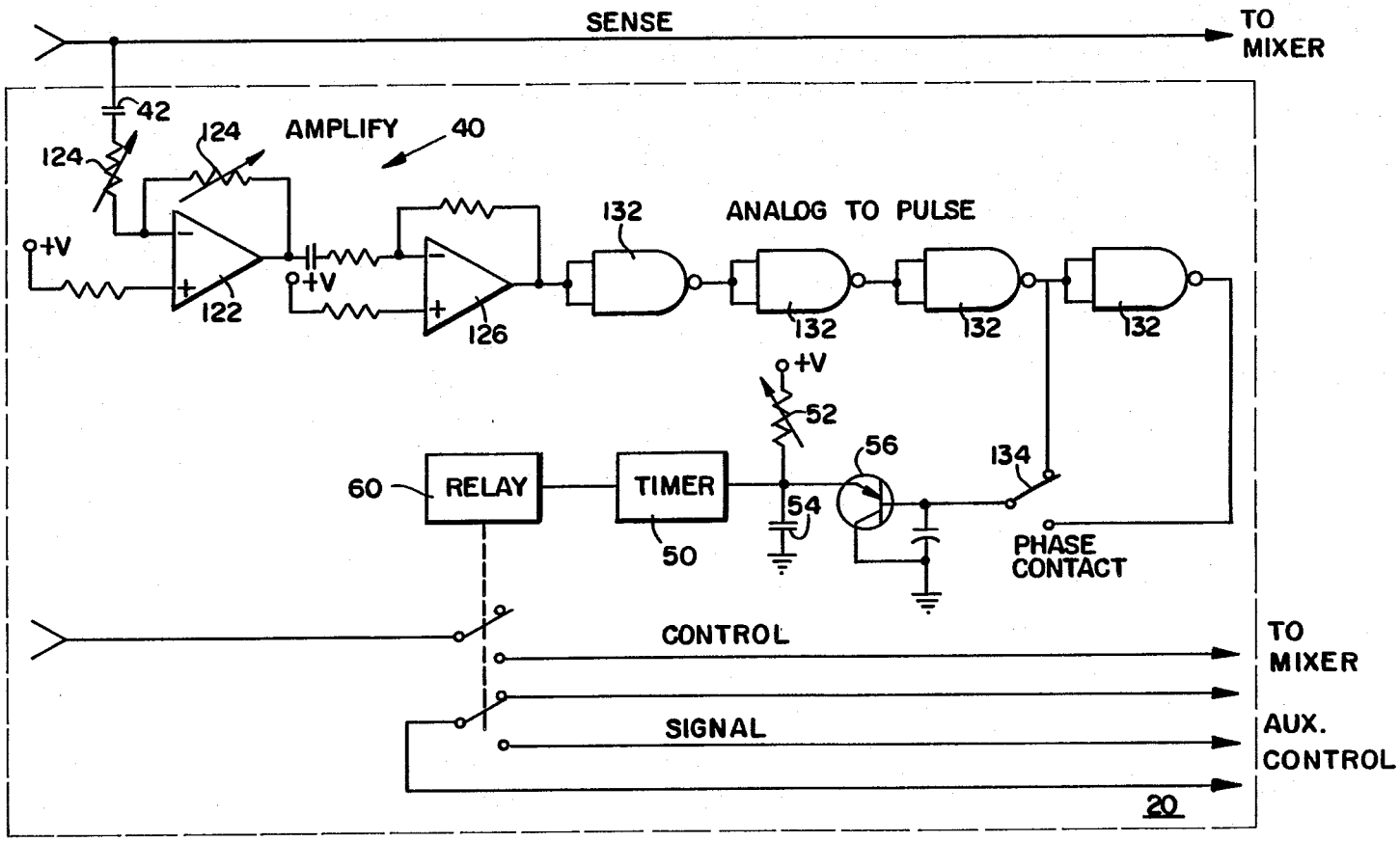
FIG. 3 is a schematic diagram of a preferred embodiment of the switching device of the invention.

FIG. 3 shows an alternative embodiment of the device, the particular circuitry between the primary audio line or "sense" line and retriggerable timer 50 being shown in detail. The "sense" line could be the output of microphone 22 or instrument preamplifier 46, or could be formed as a summed signal including components of both outputs, for example using follower amplifiers and a summing network (not shown) to develop a composite signal from both outputs.

A DC blocking capacitor 42 removes any DC bias on the sense line, for example as provided by a phantom power supply. Potentiometers 124 are connected in series with the input to amplifier 40 and as a feedback resistor for initial operational amplifier 122. Amplifier 40 comprises two operational amplifiers 122, 126, both being connected as feedback amplifiers in the embodiment shown and a DC blocking capacitor being connected in series between the two amplifiers. The gain of feedback amplifiers of this type is determined by the ratio of the feedback resistance to the series resistance along the input. In the embodiment of FIG. 3, both the series resistance and feedback resistance of the initial amplifier are adjustable, giving a sensitivity and gain control. A second amplifier stage based upon operational amplifier 126 has a fixed gain. In either event, the output of amplifier 40 is an analog audio signal proportional to the input of amplifier 40 from the sense line. It is possible to operate the second amplifier stage 126 in saturation, effectively making stage 126 a comparator, to provide a more digital representation. In any event, the output of the amplifiers is used as an input to digital circuitry, including a plurality of serially connected NAND gates 132, connected as inverters. So long as the input to the initial NAND gate 132 exceeds 3.0 V, the output will be low. When the input to initial NAND gate 132 is under 0.7 V, the output of the NAND gate will be high. At some threshold between these two, the gate changes state. The amplifiers are adjusted to provide an output varying between these nominal voltages during regular "signal-present" activity. It will be appreciated that feeding the analog output of operational amplifier 126 into a digital circuit operates as an analog to digital or analog to pulse conversion means, producing a series of digital pulses at the output of the serially connected NAND gates, the pulses being of varying time length depending upon the timing of crossings of the threshold between 0.7 and 3.0 volts at the input to the first NAND gate in line.

It is possible to adjust the sense and gain adjustments of amplifier 40 such that the output of the analog to pulse network including serially connected NAND gate 132 for pulses that are high going or low going. Switch means 134 are provided to select the phase of operation, to change between the two possible situations due to offset on the input to the amplifiers, where the output of the pulse network is primarily high or primarily low. Phase selection switch 134 is preferably set such that the input at the base of PNP transistor 56 is normally high, and goes low during activity on the sense line as amplified through amplifier 40. So long as the voltage at the base of transistor 56 is relatively high, capacitor 54 will continue to charge toward the positive voltage level through potentiometer 52. Every time a low-going pulse occurs on the base of transistor 56, the charge stored in capacitor 54 will be drained away through transistor 56 to ground. The time delay of retriggerable timer 50 is determined by the charging time of capacitor 54 through resistor 52 and is adjustable by use of a potentiometer 58, forming all or part of resistance 52. The output of retriggerable timer drives a relay 60, whose outputs connect the control line and its secondary audio signal to another channel of the mixer. Additional contacts of relay 60 are provided for closure controls for auxiliary uses, for example for signal lights, buzzers, or even to turn the power on to activate production of the supplemental audio source.

It is presently preferred that timer 50 be a standard SN 555 timer, available from a variety of sources. The RC delay for time out of retriggerable timer 50 is preferably set between 20 seconds and a minute, preferably at about 30 seconds. Whenever input activity lapses for this time period, the secondary audio source will be enabled. The optimum delay employed will depend to some extent on the character of the establishment in which the switching device 20 is used. In connection with low key lounge performers, a relatively longer delay may be appropriate. In connection with announcer situations such as fashion shows, it may be desirable to set a relatively shorter delay such that widely spaced comments by the announcer will be interspersed with periods of background music. These delays can be set up by appropriate adjustments of the potentiometers in switch means 20, and the device thereafter will automatically choose between the primary and secondary source in response to availability of the primary source.

The invention does not rely upon any form of automatic gain control, but preferably is responsive only to the level of AC variations on the sense line. Depending on background noise, a microphone output may be −40 dB (i.e., 10 mV or so) in the event of a lack of primary audio signal. A nominal signal level of 0 dB at 600 ohms will produce an input level of about 0.75 V. The threshold at which the device becomes operable should be set somewhere between these levels. The average volume level of the input must be taken into account in setting the threshold. For example, should a live rock band be the primary input source, then a typical threshold might be much higher than for a piano bar microphone, and so forth.

Figure 4:
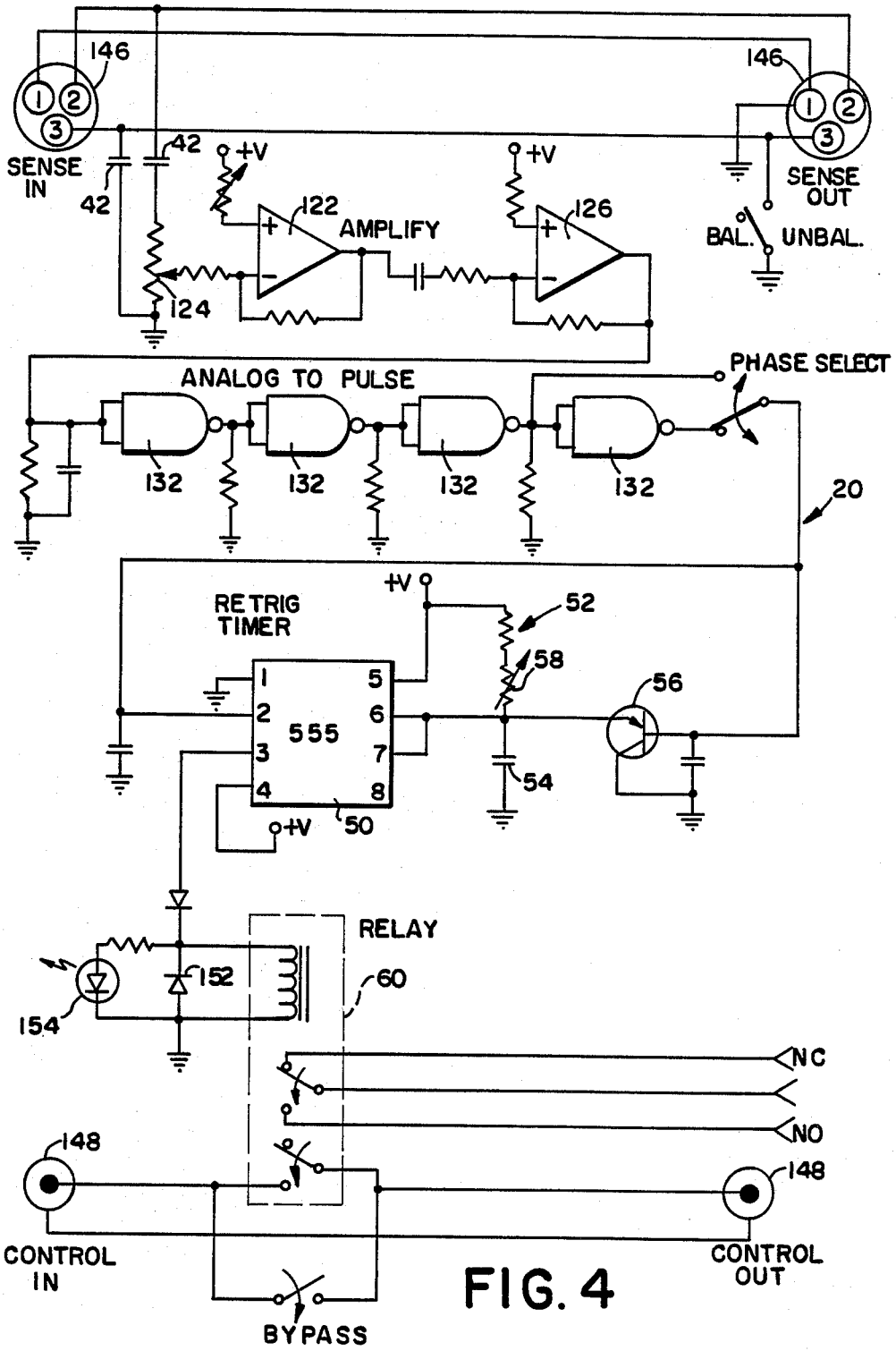
FIG. 4 is a schematic diagram of an alternative embodiment.

FIG. 4 illustrates a specific preferred embodiment. In this arrangement standard three pin audio jacks 146 are provided at the input and output of the switcher unit for the sense line. Accordingly, the microphone is simply plugged into the switcher and a standard extension cable is connected between the switcher and the mixer. A switch is provided for selecting between balanced and unbalanced inputs, in the latter event one of the signal lines being grounded. A DC voltage being possibly imposed on the signal line, for example from a phantom power source, a pair of DC blocking capacitors 42 remove the effect of such DC voltage from the input to the amplifier stages including operational amplifiers (op amps) 122 and 126. Potentiometer 124 at the input of op amp 122 determines the sensitivity of the amplifier. A second potentiometer connected between the noninverting input and the positive voltage supply can cause the op amp 122 to function as a comparator. Second stage op amp 122 is a fixed gain feedback amplifier adapted to boost the voltage from op amp 122 to a level that during signal activity will regularly exceed the digital high threshold input for NAND gates 132, connected in series with one another and operating as inverters. As before, a phase select switch allows the user to select the phase condition producing a normally high level input to transistor 56, with low-going pulses occurring during activity on the sense line. The preferably low-going pulses connected to the base of transistor 56 tend to discharge capacitor 54 which is otherwise always charging through resistor 52. Resistor 52 can include a potentiometer 58 and a fixed resistor, or can include a potentiometer only. The low-going trigger pulses are also applied to the input of 555 timer 50. When the timer 50 times out, relay 60 is energized, completing the circuit between the control input and output jacks, for example phone jacks 148. Diode 152 protects the timer output from EMF from relay 60. A light emitting diode (LED) 154 visually indicates when the device is in the secondary input mode.

In the circuit as presently preferred, operational amplifiers 122, 126 are CMOS op amp models LM3900. NAND gates 132 can be model 4011, also CMOS. A standard SN555 timer is provided for retriggerable timer 50, and can be arranged to function for very long or very short delays. Transistor 56 is preferably PNP transistor model 203. Relay 60 is preferably or double pole double throw relay drawing 20 mA at 5 V. A regulator is provided for the device providing 5 V at less than 100 mA. The unit as shown actually draws about 85 mA when relay 60 is energized and 35 mA when not energized. This is true although relay 60 only draws 20 mA, because other circuitry including LED 154 and the like, draw additional current in that mode.

According to the invention, one channel of an audio mixer can be monitored and another channel automatically controlled without intervention by an operator. Should it be desired to employ all channels of the mixer without regard to activity on the monitor channel, a bypass switch is provided to bridge the contacts of relay 60.

In the preferred embodiment, the switching device is a modular element and can be used apart from any particular downstream device such as mixer/amp 24. It is also possible to build the invention into a mixer, having switch selectable primary and secondary input channels and a switch selectable "priority" mode for the mixer. When in the "priority" mode, the mixer mixes and plays the selected primary channels, the secondary channels being automatically disabled. After activity lapses on the selected primary channels, the secondary channels are automatically enabled and remain so until the primary signal resumes.

The invention having been disclosed, a number of additional embodiments will now become apparent to persons skilled in the art. Reference should be made the appended claims rather than the foregoing specification as indicating the true scope of the subject invention.

What is claimed is:

1. An audio system, comprising:

an audio mixer having at least two inputs and an output, the audio mixer summing signals on said at least two inputs;

a primary signal source producing a primary audio signal having periods of activity and period of inactivity, the primary signal source being directly connected to one of said at least two inputs of the audio mixer;

a secondary signal source producing a secondary audio signal;

a retriggerable timer responsive to activity in the primary audio signal, the retriggerable timer timing out and producing an output at a predetermined time after cessation of activity in the primary audio signal; and, a switching means responsive to the output of the retriggerable timer, the switching means connecting the secondary audio signal to another of said at least two inputs to the audio mixer upon timing out of the retriggerable timer due to absence of the primary audio signal, whereby the secondary audio signal appears in place of the primary audio signal and the primary signal source remains connected.

2. The audio system of claim 1, wherein the primary signal source is a microphone and the secondary signal source is a recorded audio program.

3. The audio system of claim 1, further comprising an amplifier connected to the primary signal source and a comparator connected to an output of the amplifier, the comparator producing a digital output when the primary audio signal exceeds a predetermined level, the digital output of the comparator being connected to a trigger input of the retriggerable timer.

4. The audio system of claim 1, further comprising an amplifier connected to the primary signal source by a high pass filter, the primary signal source being a microphone powered by a DC voltage impressed on said one of said at least two inputs to the audio mixer, and a comparator producing a digital output when the primary audio signal exceeds a predetermined level, the digital output of the comparator being connected to a trigger input of the retriggerable timer.

5. An audio switching device for a live microphone audio system having a microphone signal connected to an input of an audio mixer having an audio output, the microphone signal being subject to periods of inactivity, and at least one background signal source having an output to be routed to said audio output of the mixer during said periods of inactivity, comprising:

a retriggerable timer having a trigger input connected to the microphone signal, the retriggerable timer being operable to time said periods of inactivity and to provide an output when one of the period of inactivity exceeds a predetermined length;

a switch responsive to the output of the retriggerable timer, the switch connecting the output of the background signal source to the mixer and thereby enabling the background signal source upon timing out of the retriggerable timer, the microphone signal remaining connected to the input of the audio mixer.

6. The audio switching device of claim 5, further comprising an amplifier amplifying the microphone signal and a comparator connected to an output of the amplifier, the comparator providing a digital output connected to the trigger input of the retriggerable timer, the comparator changing state upon an output of the amplifier crossing a predetermined threshold level.

7. The audio switching device of claim 6, wherein at least one of an input level to the amplifier, a gain of the amplifier and a phase of the comparator output are variable by manual control.

8. An audio switching device for a live microphone audio system having a microphone signal subject to periods of inactivity and at least one background signal source having an output to be substituted for the microphone signal during said periods of inactivity, comprising;

a retriggerable timer having a trigger input connected to the microphone signal, the retriggerable timer being operable to time said periods of inactivity and to provide an output when one of the periods of inactivity exceeds a predetermined length;

a switch responsive to the retriggerable timer, the switch disabling the microphone signal and enabling the background signal source upon timing out of the retriggerable timer;

an amplifier amplifying the microphone signal and a comparator connected to an output of the amplifier, the comparator providing a digital output connected to the trigger input of the retriggerable timer, the comparator changing state upon an output of the amplifier crossing a predetermined threshold level; and, at least two inverters disposed in series between an output of the comparator and said trigger input of the retriggerable timer.

9. The audio switching device of claim 8, wherein the retriggerable timer is connected to a resistor and capacitor network, the predetermined length of said periods of inactivity being timed by charging of the capacitor through the resistor, and further comprising a transistor connected to discharge the capacitor upon changing of state of the comparator output.

10. The audio switching device of claim 5, wherein the amplifier is coupled to signal lines to the microphone signal through a high pass filter, whereby the microphone can be phantom powered.

11. An audio system, comprising:

a mixer adapted to produce an audio output, the mixer having at least two input channels;

a least two audio inputs carrying audio input signals, connected to the mixer input channels through a switching device, at least one of the audio input signals being produced by a live microphone input carrying a live microphone signal, wired directly through the switching device to one of the mixer input channels, the live microphone signal being subject to periods of inactivity and another of the audio input signals being from a background signal source to be reproduced on the mixer output during said periods of inactivity;

the switching device comprising a retriggerable timer having a trigger input connected to the live microphone signal, the retriggerable timer being operable to time out whenever the live microphone signal fails to cross a predetermined threshold for a predetermined length of time, the switch device being operable to connect the background signal to the mixer input channels, commencing upon timing out of the retriggerable timer and continuing until the live microphone signal again crosses said predetermined threshold, said live microphone input remaining operationally connected to said one of the mixer input channels during the periods of inactivity.

12. The audio system of claim 11, wherein the switching device connects the background signal to an individual input channel of the mixer other than said one of the said mixer input channels to which the live microphone signal is connected.

13. The audio system of claim 12, wherein the live microphone signal is produced by at least one of a condenser microphone and an instrument preamplifier powered by a DC bias voltage impressed on said one of the mixer input channels at the mixer, the switching device retaining said DC bias and thereby keeping the live microphone signal enabled for resumption of activity at any time during said periods of inactivity.

14. The audio system of claim 13, further comprising an amplifier connected to said at least one of the live microphone input and the instrument preamplifier through a high pass filter, and a comparator in series with the amplifier, the comparator producing a digital output when the output of the amplifier exceeds a predetermined threshold.

15. An audio system, comprising:

a mixer adapted to produce an audio output, the mixer having at least two input channels;

at least two audio input signals connected to the mixer through a switching device, at least one of the audio input signals being produced by a live microphone input carrying a live microphone signal subject to periods of inactivity and another of the audio input signals being connected to a background signal source having an output to be enabled during said periods of inactivity;

the switching device comprising a retriggerable timer having a trigger input connected to the live microphone input, the retriggerable timer being operable to time out and disable said live microphone signal whenever the live microphone signal fails to cross a predetermined threshold for a predetermined length of time, the switch device being operable to enable the background signal commencing upon timing out of the retriggerable timer and continuing until the live microphone signal again crosses said predetermined level;

an amplifier connected to said at least one of the live microphone input and an instrument preamplifier through a high pass filter, and a comparator in series with the amplifier, the comparator producing a digital output when the output of the amplifier exceeds a predetermined threshold; and, signal shaping means in series with an output of the comparator, the signal shaping means including a plurality of serially connected inverters, and further comprising a phase reversal switch for selecting outputs of the signal shaping means from outputs of successive ones of the serially connected inverters.

16. The audio system of claim 15, wherein the retriggerable timer times out upon charging of a capacitor through a resistor, and further comprising a transistor operable to discharge the capacitor upon occurrence of the digital output of the comparator.

17. The audio system of claim 11, wherein the switching device is located in the mixer.

18. The audio system of claim 11, wherein the switching device is external to the mixer.

* * * * *